United States Patent [19]

De Meirsman

[11] Patent Number: 4,639,717

[45] Date of Patent: Jan. 27, 1987

[54] METHOD AND APPARATUS FOR MONITORING FLAME CONDITION

[75] Inventor: Laurent De Meirsman, Groot-Bijgaarden, Belgium

[73] Assignee: Electronics Corporation of America, Waltham, Mass.

[21] Appl. No.: 755,179

[22] Filed: Jul. 15, 1985

[51] Int. Cl.[4] ..... G08B 17/06

[52] U.S. Cl. ..... 340/578; 250/554; 340/577; 431/79

[58] Field of Search ..... 340/578, 577; 250/554; 431/79; 110/185, 193

[56] References Cited

U.S. PATENT DOCUMENTS

| | | | |
|---|---|---|---|
| 2,811,711 | 10/1957 | Cade et al. | 340/578 |
| 3,805,258 | 4/1974 | Longrigg | 250/554 |
| 3,824,391 | 7/1974 | Noltingk et al. | 340/578 |
| 3,995,221 | 11/1976 | MacDonald | 340/578 |
| 4,039,844 | 8/1977 | MacDonald | 340/578 |
| 4,368,031 | 1/1983 | Chadshay . | |

*Primary Examiner*—Glen R. Swann, III

*Attorney, Agent, or Firm*—Charles E. Pfund

[57] ABSTRACT

A flame monitor senses flame brightness and produces two signals corresponding to rapid brightness variations and average brightness. By comparing rapid signal variations to a fraction of the average a threshold ON-OFF signal representing normal flame operation is obtained that can be processed as a fail-safe indication and control. High and low limit thresholds can be set and compared with average brightness as a further condition of proper flame operation.

12 Claims, 6 Drawing Figures tions a flame flicker signal which reliably indicates the presence of a flame in a multi-burner environment.

A further object of the invention is to provide a flame monitor which also includes an average brightness threshold circuit for sensing the change of a photodetected signal from the average level associated with the flame to the average level associated with the general fire ball in the fire box.

A still further object of the invention is to provide for fail-safe processing of a threshold digitized signal representing a good flame using the flame flicker frequency as the alternating component of the fail-safe circuit such that any interruption of transmission of this alternating signal results in a flame-out signal to indicate loss of flame or failure of any component in the circuit.

A still further object of the invention is to provide for upper and lower average brightness threshold levels against which the average brightness signal is compared to detect when the photoresponsive sensor has changed from observing a burner flame to observing the general fire box environment radiation.

These and other objects of the invention will become clear from the following detailed description.

DETAILED DESCRIPTION OF THE PREFERRED EMBODIMENT

Figure 1:
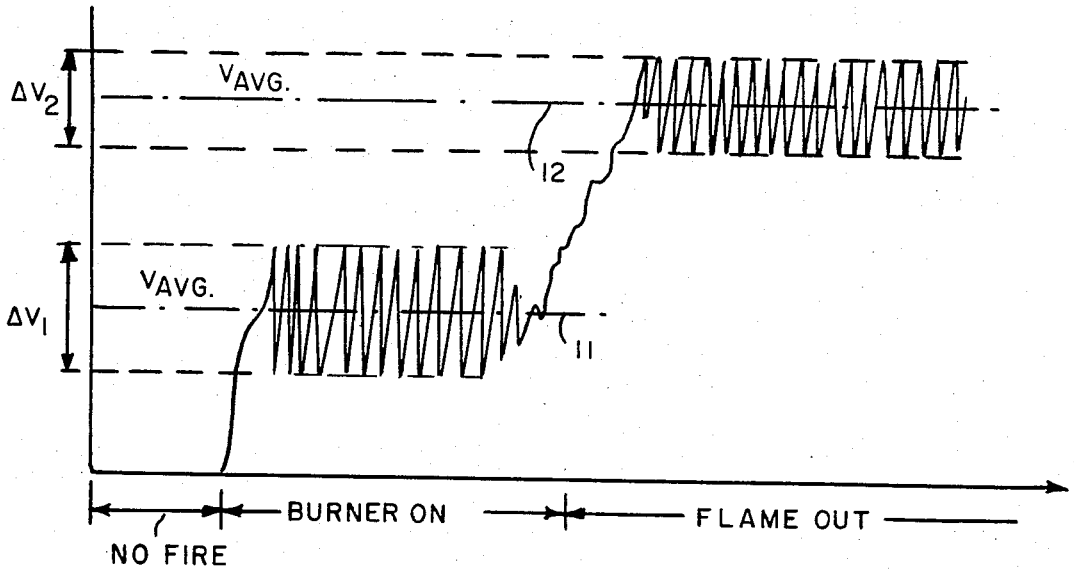
FIG. 1 is a representation of a signal representing detected flame brightness including both the fluctuations in brightness and the average brightness characteristic of certain burner flames in multiburner installations.

Referring to FIG. 1, the characteristics of brightness sensed by a fast response photosensor when observing a pulverized coal flame shows that initially during the no-fire interval there is no signal and as soon as the burner is turned on the signal increases to a first average level 11 with fluctuations relative to that level $\Delta V_1$. As indicated in FIG. 1 the average signal level is relatively low and the excursions from that average are relatively large. In a multiburner installation when the observed flame goes out the response of the photodetector increases in average value and the excursions relative to that increased average value 12 are less relative to $\Delta V_1$ as indicated by the fluctuation level $\Delta V_2$. These features of a pulverized coal flame and other fuels which permit amplitude discrimination between the proper burner flame and flame-out conditions provide the basis for reliably detecting flame-out condition and obtaining a continuous reliable indication of good flame while the burner is operating properly to produce a normal flame.

Figure 2:
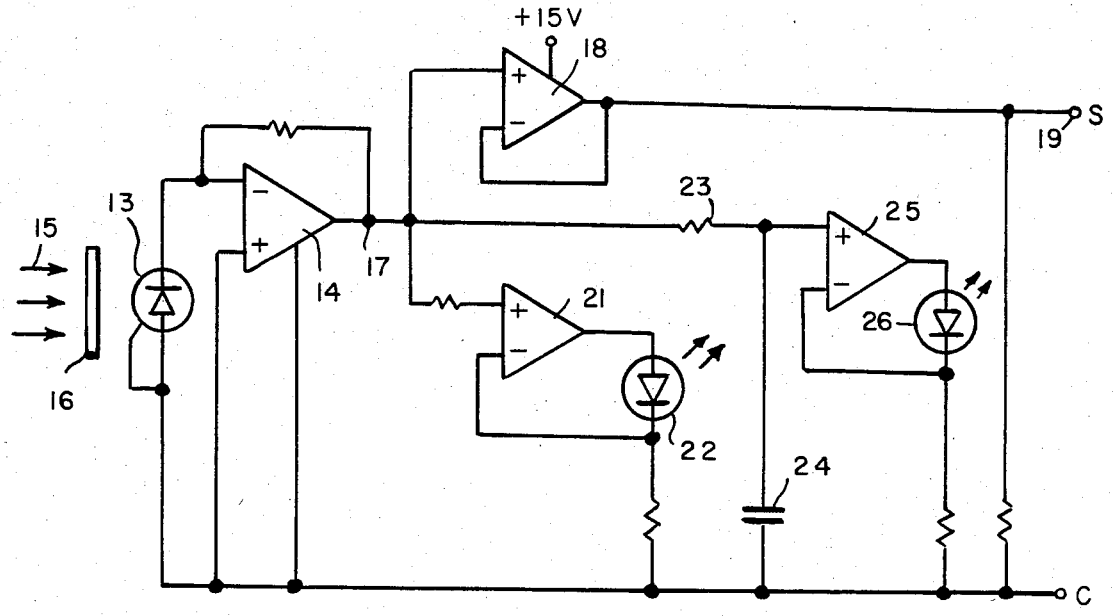
FIG. 2 is a schematic circuit diagram of the sensor portion of the present invention.

Referring to FIG. 2, the photosensor circuit comprises a silicon photodetector 13 connected to a feedback amplifier 14 with the photosensor 13 operating in a short circuit or current generator mode that produces a wide dynamic range with approximately a linear signal output proportional to the brightness or intensity of radiation 15 which arrives through a suitable sight tube, to be later described, and passes through a flat glass plate 16 to eneregize the photoresponsive device 13. Accordingly, the output of amplifier 14 at line 17 is a fast response fluctuation representing the brightness fluctuations of the flame. This fluctuating signal is applied through a buffer amplifier 18 to an output terminal 19 to provide the signal S to the controller circuit of FIG. 3.

The fluctuating signal on output 17 of amplifier 14 is also applied to an amplifier 21 which drives an LED indicator 22 at the signal fluctuation rate. The fluctuating signal on output 17 is also applied to an RC integrator circuit 23, 24 where it is averaged and applied to an amplifier 25 which drives an LED indicator 26 which indicates the average level of the signal by observing the brightness of the LED 26. The use of the LED indicators 22 and 26 for orienting the pre-photocell optical elements to observe the proper portion of the flame will be described hereinafter.

Figure 3:
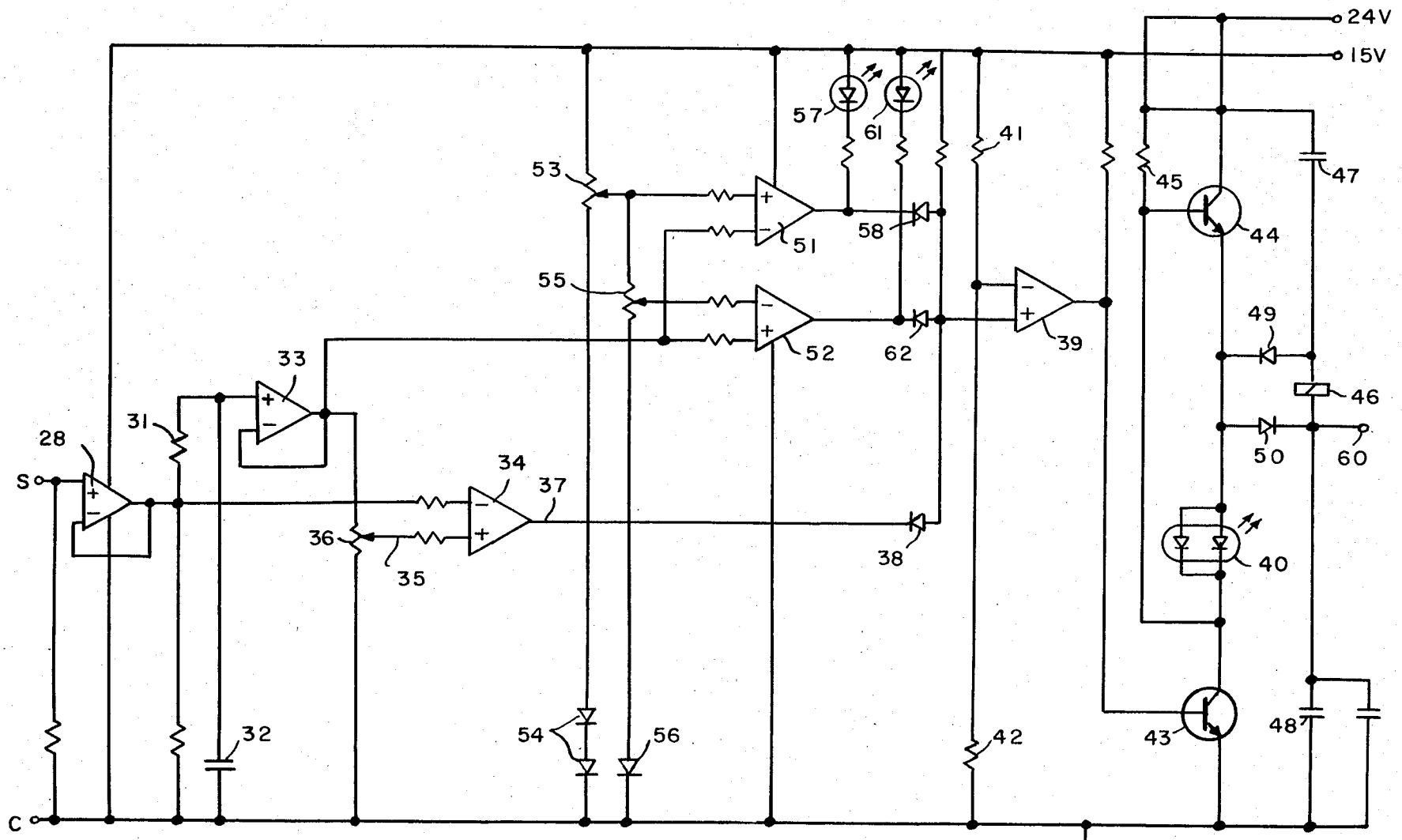
FIG. 3 is a schematic circuit diagram of the processor and controller portion of the present invention.

Referring now to FIG. 3, the signal S on terminal 19 of FIG. 2 is applied to a buffer amplifier 28 the output of which is applied to an RC averaging circuit 31, 32 to provide an average intensity input signal to an amplifier 33. The buffered flame fluctuation signal output of amplifier 28 is also applied as one input to a comparator circuit 34. The other input of comparator 34 is derived from a movable contact 35 on a potentiometer 36 across which is the average voltage output of amplifier 33.

Output 37 of comparator 34 is a threshold digitized signal representing the excursions of the flame fluctuation signal from amplifier 28 which exceed the threshold set by movable contact 35 as a fraction of the average brightness signal output of amplifier 33. Thus so long as the flame flicker has sufficient amplitude to exceed the threshold set by contact 35 a digitized signal on line 37 is available to indicate presence of the flame.

The signal on line 37 is applied through a gating diode 38 to a comparator 39, the other input of which is a fixed value obtained from the midpoint of a voltage divider 41, 42. The output of comparator 39 is a replica of the digitized signal on line 37 with less noise due to the comparison process relative to a fixed voltage level provided by the divider 41, 42. The digitized ON-OFF fluctuation signal output of comparator 39 is applied to the base of a current switching transistor 43, the collector of which is connected to the base of a current switching transistor 44. The collector emitter paths of transistors 43 and 44 are connected in series through an indicator LED 40 across the 24-volt power supply. The base of transistor 44 is returned through a resistor 45 to the 24-volt supply which thus serves as a load resistor for transistor 43. This circuit for transistors 43 and 44 assures that either transistor 43 or 44 will conduct depending upon the polarity of the ON-OFF digitized signal from amplifier 39 and thus they will switch alternately between the on and off condition with only one transistor 43 or 44 conducting at any given time. This switching of transistors 43 and 44 is used to provide fail-safe energization of a flame relay 46. For this purpose a large charging capacitor 47 connects the relay 46 to the 24-volt supply with the other terminal of the relay energizing coil connected through a large capacitor 48 to the negative supply. Two diodes 49 and 50 connect the terminals of the relay 46 to the emitter

METHOD AND APPARATUS FOR MONITORING FLAME CONDITION

BACKGROUND OF THE INVENTION

Monitoring of flames in industrial or utility power plants to assure satisfactory and efficient operation and obtain an indication or control signal for shut-down in the event of malfunction is standard practice. Various forms of monitoring systems are known including various forms of photocell sensor systems which attempt to detect the presence of the flame and produce an indication or control signal when the flame goes out or becomes unsatisfactory for any reason.

In the past, flame scanners or monitors have relied upon flicker characteristics of the flame to produce an alternating signal component superimposed on a background signal level representing average brightness. An example of circuits of this type is found in the U.S. Patent to Cade U.S. Pat. No. 2,811,711. A later form of flame monitor which uses different frequency characteristics of the flame to develop control signals was the patent to MacDonald U.S. Pat. No. 4,039,844.

These and other prior art flame monitor circuits which relied upon the frequency characteristic of the flame have provided satisfactory operation, particularly with reference to flames from burning oil or gas as fuel where the flame is relatively steady and the radiation therefrom can be directly observed. Some flames from these fuels and the flames which are produced in large power plant installations by burning pulverized coal have different characteristics and in certain respects present problems not found in monitoring well behaved oil and gas flames.

One of the problems which is present in large industrial or utility power plants is the presence of multiple burners which feed the same fire box with the internal volume occupied by a large fire ball and the walls of the firebox becoming so hot that the walls themselves provide radiant energy which will energize a photodetector. In such systems the ability to detect when an individual burner flame has gone out is complicated by the fact that the photoresponsive sensor in the absence of flame in the burner which it is monitoring will see the fire ball or the radiation from the fire box wall and thus its response will not necessarily fall to zero merely because the flame it is monitoring has gone out. It is for this reason that the various flicker frequency characteristics of the flame and other spectral bases for discriminating an actual burner flame from other radiation present in the environment have been researched and employed for many years.

As noted, there are certain flames which are more difficult to monitor than others. One such type of flame is the result of burning pulverized coal of which there are many types. For example, stone coal, brown coal and lignite all have different firing characteristics and produce characteristic flames when supplied to a burner in pulverized form to produce the flame. Such fuels are generally opaque and do not instantly ignite as the nozzle discharges them into the fire box at the burner nozzle. When the pulverized coal does ignite a large increment of luminousity is generated at an area which just previously was occupied by opaque coal dust. Thus to a photodetector which is observing such an area there is a large fluctuating component in the brightness of the area and if the photo detector responds at high speed the signal that is obtained will be a rapid fluctuation relative to an average level representing the average brightness of the observed flame. Extensive work has been done in an attempt to utilize frequency discrimination to monitor flames having these high level fluctuations in order to find a characteristic which can be relied upon to indicate the presence of a proper and well behaved flame and the immediate indication that the flame has disappeared or degraded to such an extent that it needs attention.

In all of the flame monitoring systems for industrial power plants the energy content of the fuel is such that an immediate and reliable indication of flame-out is imperative since the discharge of unburned fuel from a burner that has had the flame extinguished into the fire box creates a highly dangerous condition which if it remains unchecked for any length of time is likely to result in a dangerous explosion.

BRIEF SUMMARY OF THE INVENTION

It is an object of the present invention to provide a burner flame monitor which can be used on flames which have an inherent high intensity fluctuation relative to average brightness as a normal characteristic of their operation, examples of such flames being those obtained upon burning pulverized coal in industrial or public utility power plants. In accordance with the present invention, such flames are observed with a fast response sensor sensitive to brightness or light intensity to develop a fluctuating signal representing the rapid fluctuations in brightness of the flame. The average value of this fluctuating signal is derived and the fluctuations are compared to the average value or a portion thereof to obtain a threshold or clipped version of the flame intensity fluctuation. For flames of this type, applicant has discovered that the intensity fluctuations are relatively large excursions with reference to a relatively low average brightness level for a normal flame and that for flame-out condition the average brightness increases and the fluctuations decrease. The reason for this apparently is due to the characteristics of the fire ball in a large industrial or utility installation where a number of other burners are contributing to the flame and the overall combustion in the center of the fire box becomes brighter but exhibits less fluctuation amplitude relative to the increased brightness. By developing the flame signal as representative of the excursions of the fluctuations relative to an average value that must exceed a certain threshold an indicating and control signal is obtained preferably by selecting the excursions in excess of threshold to reliably indicate the presence of the flame. When the flame disappears the increase in average brightness correspondingly increases the threshold in the presence of lower amplitude fluctuations which results in fewer peak fluctuations exceeding the threshold thereby reducing the signal to a rate of alterations lower than that which the subsequent circuit processes as a flame signal. Thus the amplitude characteristics of both the average value and the fluctuations are utilized as the primary criterion for detecting flame presence or absence with the frequency of fluctuations only employed to derive a fail-safe threshold or digitized signal.

Accordingly, the primary object of the present invention is to provide an amplitude discriminatory system for burner flames which exhibit large intensity fluctuations relative to an average brightness level as characteristic of a good flame and deriving from these fluctuacollector junction connection between transistors 43 and 44.

The operation of the fail-safe circuit for a square wave or digitized control signal derived from amplifier 39 can be described as follows. When transistor 43 is conducting, transistor 44 is non-conducting and current flows from the 24-volt supply to charge capacitor 47 through diode 49 and conducting transistor 43. When the digital signal from amplifier 39 changes polarity transistor 43 is cut off and transistor 44 conducts. For this condition current flows from the 24-volt supply through transistor 44 and diode 50 to charge capacitor 48. At this time however, conducting transistor 44 permits charged capacitor 47 to discharge through transistor 44, conducting diode 50 and relay coil 46. Upon the next polarity change transistor 43 is conducting permitting capacitor 47 to recharge and at the same time permitting capacitor 48 to discharge through relay 46, conducting diode 49 and transistor 43. It will be noted that for both polarity conditions the capacitors 47 and 48 discharge with current flowing unidirectionally through the relay 46 and thus a substantially steady holding current is applied to the relay 46 so long as a digitized signal output is received from amplifier 39. Upon the failure of any component or upon the failure of the flame to provide the digitized signal from amplifier 39 the capacitors 47 and 48 will prevent a steady DC current flow to relay 46 and the relay will drop out indicating flame failure or circuit fault. Thus the circuit is self monitoring and fail-safe.

Referring again to FIG. 3, the average value signal output of amplifier 33 is applied as an input to a high limit comparator 51 and a low limit comparator 52. The other input of high limit comparator 51 is obtained from a potentiometer 53 as an adjustable level between the supply voltage and a one volt reference provided by two series diodes 54. The other input of the low limit comparator 52 is derived from a potentiometer 55 which is connected across the selected value from potentiometer 53 to a 0.5 volt reference provided by diode 56.

The output of high limit comparator 51 drives an indicator LED 57 and is applied to a gating diode 58 which connects the output of comparator 51 to the digitized signal input of comparator 39.

The output of low limit comparator 52 is applied to drive a LED indicator 61 and through a gating diode 62 to the digitized input of comparator 39.

The comparators 51 and 52 provide no output so long as the average brightness signal from amplifier 33 does not deviate outside the lower and upper limits set by the setting of potentiometers 55 and 53 respectively. For this condition the LEDs 57 and 61 are not lit and the diodes 58, 62 do not conduct thereby having no effect on the passage of the digitized signal on line 37 through diode 38 to the input of comparator 39. If the average value signal exceeds the upper limit set by potentiometer 53 the LED 57 will be lighted and diode 58 will conduct thereby inhibiting the digitized signal on LED 37 from passing through diode 38 to comparator 39. Similarly, if the average brightness signal from amplifier 33 is below the level set by potentiometer 55 LED 61 will be lighted and diode 62 will conduct to inhibit the digitized signal from reaching amplifier 39. In this manner, the circuit sets the upper and lower limits for the average value and indicates the occurrence of an average value outside these limits as well as inhibiting the flame signal to indicate that operation is not within normal limits.

The ultimate use of the circuit in energizing flame relay 46 is as conventionally employed in the flame monitoring industry to indicate proper operation or improper or fault operation and the application of suitable controls like fuel cut off or the like as desired. For this purpose the relay 46 can actuate any desired control contacts. Furthermore, the operation of the circuit can be monitored by suitable recorders or meters by connecting to a terminal 60 as a flame signal readout.

Figure 4:
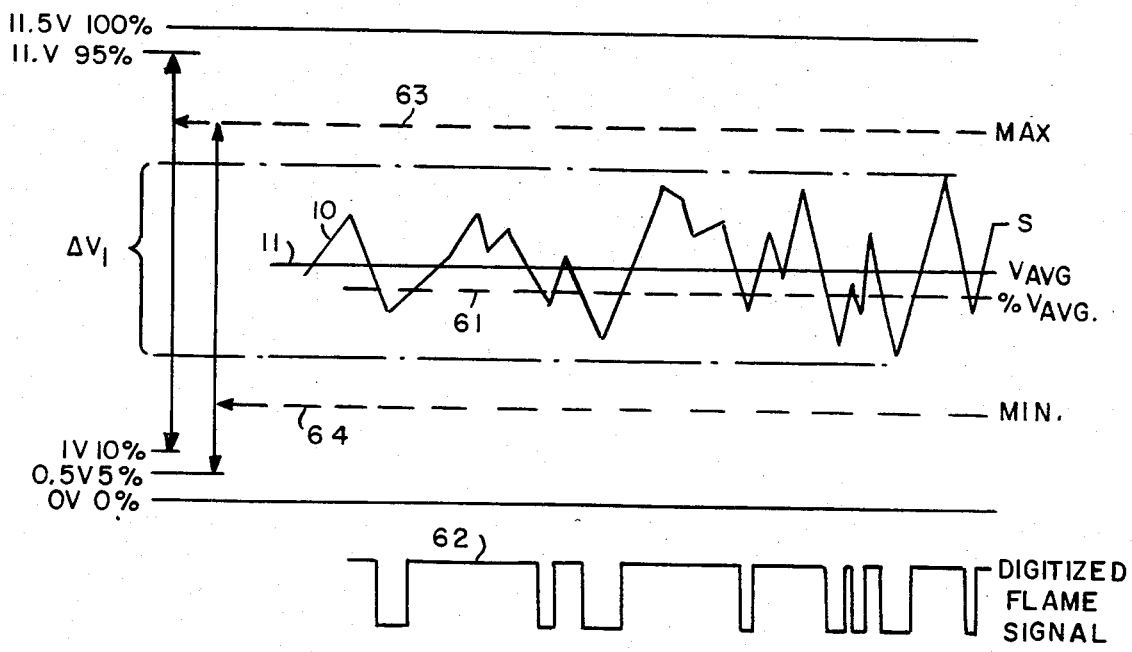
FIG. 4 is a signal waveform diagram showing various features of operation of the circuit of the present invention.

Referring now to FIG. 4, the derivation of the threshold digitized flame signal and its relation to various levels set will be described. As explained with reference to FIG. 1, during normal burner operation the intensity or brightness of the flame sensed by the photocell 13 has an average value 11 about which the actual fast response intensity signal 10 varies with excursions which are substantially larger than for the variations obtained when observing the fire ball or interior of the fire box with a flame absent. Such excursions in FIG. 4 are again indicated as $\Delta V_1$. The potentiometer 36 permits selection of a portion of the average signal level 11, $V_{avg}$, which level is represented as dotted line 61 in FIG. 4. With this voltage level on line 35 as an input to comparator 34 and the other input receiving the fast response brightness variation signal 10, the comparator 34 produces the threshold digitized flame signal 62 shown in FIG. 4. This digitized signal changes state every time the flame brightness signal 10 crosses the threshold 61 as indicated. As described with reference to the high and low limit comparators 51 and 52 in FIG. 3, a maximum limit 63 and a minimum limit 64 are established as shown in FIG. 4. The high limit 63 has a range from approximately 95 percent of the 11-volt supply down to approximately one volt as established by the drop in the series diodes 54. The low limit 64 which operates from whatever the high limit 63 setting may be extends from that level down to approximately 0.5 volts corresponding to the drop in diode 56. Thus the high and low limits 63 and 64 can be set to encompass the expected average brightness for a particular fuel in a particular power plant. It should be noted, particularly in burning pulverized coal, that once the fuel and characteristics of a particular power plant are established, the type of fuel burned is never changed. Accordingly, an initial set up calibrating the limits 63 and 64 can reliably bracket the range of average intensity levels 11 that correspond to normal flame operation with that particular fuel. Similarly, by setting levels 61 as a percentage of the actual average value 11 a useful digitized signal 62 can be obtained which has a logical switching rate adequate for use as a fail-safe signal as has been described and for subsequent processing in the system. Again, the excursions of the fast response signal 10 for a particular fuel will lie within a fairly well known range so that the setting of level 61 to obtain the digitized signal 62 can be established during initial set up of the burner monitor system.

It will be appreciated that during normal operation the average level 11 for the signal $V_{avg}$ will not be a straight line but will vary continuously within a limited range for normal burner flame operation. Since the excursions of the brightness signal 10 tend to vary in the same proportion the average level 11, the variations in the average level will not greatly effect the digitized signal 62 since the variations in average level will also cause the per cent $V_{avg}$ signal 61 to vary and be proportionately positioned relative to such variations in the average level 11.

For a flame-out condition as indicated in FIG. 1, the average level 12 increases and the excursions $V_2$ of the signal following variations in brightness become smaller for fuels such as pulverized coal.

As indicators of operation within the established ranges the LED 57 when illuminated indicates that the average value has exceed the preset MAX 63 in FIG. 4. Similarly, the LED 61 when illuminated indicates that the average value has dropped below the low limit setting level 64. The modulation rate is indicated by the flashing of LED 40 since the switching rate of transistors 43 and 44 is directly controlled by the digitized signal changes derived from comparators 39 and 34. Thus setting potentiometer tap 35 and observing LED 40 permits the selection of a suitable digitized modulation rate.

Figure 5:
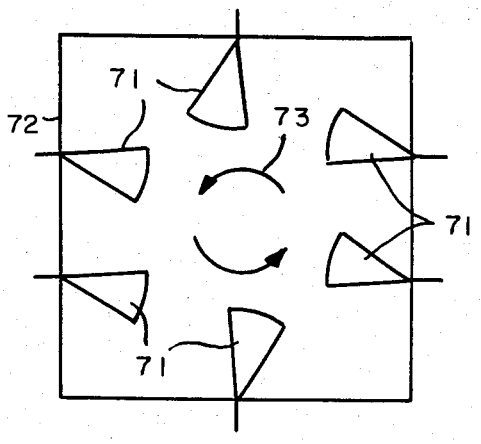
FIG. 5 is a schematic plan view of a tangentially fired multiburner fire box.
Figure 6:
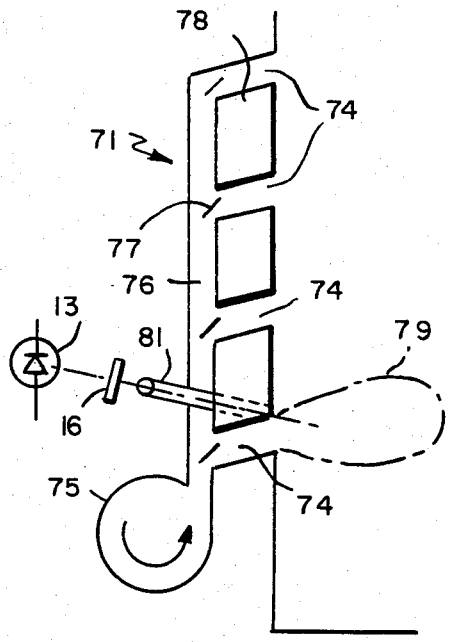
FIG. 6 is a schematic elevational view of a multi-nozzle mill for delivering and burning pulverized coal with an indication of the optical arrangement for the photosensor of the present invention.

Referring now to FIG. 5, a plan view of a tangentially fired multi-burner power plant is indicated wherein a plurality of burners 71 are arranged around the periphery 72 of a fire box and aimed at approximately tangential angles to project their burner flames into a central area 73 where under normal operation a fire ball resulting from all the burner flames merges and mixes the fuel air combination for complete combustion. Generally, an individual burner 71 as shown in FIG. 5 is in actuality a stack of burner "fingers" 74 arranged as shown in FIG. 6 in a vertical array above a mill 75 which is power driven to pulverize the incoming coal and mix it with the forced air feed to blow it up shaft 76 where baffles 77 divert portions of the pulverized coal stream to be blown out the individual fingers 74. In between the fingers 74 is the wind box 78 which supplies combustion air augmenting the air which is transporting the pulverized coal up the vertical conduit 76.

During normal operation of a multi-burner stack shown in FIG. 6, each finger 74 produces a flame 79.

The monitor of the present invention when employed in a burner such as shown in FIG. 6 is preferably oriented toward the bottom finger 74 which will be the coldest portion of the stack. Generally, the heat from the lower flames will assure that the higher flames above finger 74 will have proper combustion if the lower finger 74 is producing a proper flame 79. Accordingly, the sensor of this invention is mounted preferably on the lower finger 74 using a sight pipe 81 mounted to be capable of being pivoted in approximately the position shown. The flat glass window 16 protecting photocell 13 of the sensor of FIG. 2 is located to permit radiant energy from the flame 79 to be transmitted through the glass plate 16 to energize the photocell 13. Since flat glass plate 16 instead of a lens is employed the optics are not critical as to adjustment. The entire assembly of photocell 13, glass plate 16 and sight pipe 81 are mounted together and the sight pipe 81 is pivoted to find the best spot on the flame 79 for monitoring flame intensity. Referring to FIG. 2, the instantaneous brightness or flicker and the average brightness components of the flame can be found by positioning the sight pipe 81 and observing the LEDs 22 and 26. Thus LED 22 which follows the instantaneous brightness is observed for maximum flame flickering while LED 26 which observes the average value of brightness is used to find a spot on the flame where a steady average intensity exists in conjunction with a high level of flame flicker as indicated by LED 22. With these adjustments made and the calibration settings previously described with reference to FIG. 3, the system is ready to operate.

During normal flame operation the system operates and the normal flame relay condition of being energized provides the usual control and indication signals. If a flame-out occurs the increase in average brightness and the decrease in the variations relative to that increased brightness operate to prevent the digitized signal from reaching the fail-safe circuit through comparator 39. The system achieves this result reliably due to the reduction of modulation excursions of the flicker signal not exceeding the threshold 61 hence causing the digitized ON-OFF signal 62 to disappear to be too sporadic to properly support the fail-safe circuit following comparator 39. Furthermore, the increase in the average value from level 11 to level 12 as indicated in FIG. 1 will generally exceed the high limit threshold established by comparator 51 to inhibit the diode 38 and prevent passage of the digitized signal from comparator 34 to the comparator 39. A low average brightness will similarly inhibit any digitized signal if brightness falls below the low limit 64 set by comparator 52. Comparators 34, 39, 51 and 52 can be obtained as a single integrated circuit package operating from power supply connections as shown to comparators 51, 52.

The system accordingly is highly reliable particularly with the difficult fuels such as pulverized coal which have extreme flicker characteristics and do not offer the usual distinguishing characteristics such as mere detection of variations in frequency or brightness alone and hence such characteristics cannot be relied upon. The present system, however, follows wide variations in a pulverized coal flame which are present during a normal operation and uses both the average value and the flicker excursions in brightness to reliably distinguish against the generally higher brightness signal obtained from the fire ball or interior of the fire box in a multiburner system.

Various applications of the present invention will occur to those skilled in the art wherever fuels are burned in a system which exhibits amplitude brightness characteristics of the type which can be sensed and processed to distinguish between both the average and instantaneous brightness characteristics of a true and proper flame as opposed to those of the environment in which the flame exists.

I claim:

1. In a multiburner system, a flame monitor for determining the condition of a particular burner flame which has continuous luminous intensity fluctuations during normal operation which vary substantially relative to the average intensity of said flame comprising:

a sensor responsive to said luminous intensity fluctuations for producing a flame signal which varies with said fluctuations over a wide range of intensities;

means for mounting said sensor to receive light from said particular flame with the field of view for said sensor including the portion of the combustion chamber of said system beyond the flame being monitored; and means responsive to excursions of said flame signal relative to the average value thereof exceeding a threshold level for producing a flame presence signal.

2. A flame monitor according to claim 1 adapted for sensing a pulverized coal flame and including circuit means for varying said threshold level directly as a function of said average value.

3. The monitor according to claim 2 and including means for selecting said threshold level to be a percentage of said average value.

4. A flame monitor according to claim 1 wherein said means for producing said flame presence signal includes means for comparing said flame signal excursions with said threshold to produce a digitized signal corresponding to intervals wherein said flame signal excursions do and do not exceed said threshold, and means for utilizing said digitized signal as said flame presence signal.

5. A flame monitor according to claim 1, 2, 3 or 4 and including a relay circuit having a relay energized by said flame presence signal.

6. A flame monitor according to claim 4 and including a relay, a circuit responsive to said digitized signal for supplying current flow to said relay alternately via two paths during the respective on and off intervals of said digitized signal, said relay being energized only if said current flows alternately in said two paths at a sufficient on off rate of said digitized signal.

7. A flame monitor according to claim 4 and including means for comparing said average value with a first selectable value for establishing an upper limit signal level for said average value;

means for comparing said average value with a second selectable value for establishing a lower limit signal level for said average value; and gating means operable to pass said digitized signal to said means for utilizing only if said average value is within the range between said upper and lower limit signal levels.

8. A flame monitor according to claim 7 wherein said means for utilizing said digitized signal comprises:

a relay;

a pair of storage capacitors;

a pair of signal actuated current switches connected to be switched to opposite on and off condition by said digitized signal; and circuit means connecting said capacitors and said switches to alternately charge said capacitors through said switches respectively and discharge current unidirectionally through said relay in response to said digitized signal, said relay being energized by said discharge current from said capacitors and deenergized upon absence of said discharge current.

9. A pulverized coal flame monitor comprising:

a flame intensity sensor for producing a fast response signal which varies with the intensity of an observed flame;

means for obtaining the average value of the sensed intensity signal;

means for comparing the sensed intensity signal with a fraction of said average intensity value to produce an output signal only if the instantaneous signal varies in amplitude a predetermined amount relative to the average value;

means responsive to said output signal to indicate flame presence; and means responsive to said average value's falling outside pre-selected upper or lower limits for disabling said output signal thereby indicating flame absence.

10. In a multiburner pulverized coal combustion system, a flame monitor for determining the condition of a particular burner flame which has continuous luminous intensity fluctuations during normal operation which vary substantially relative to the average intensity of said flame comprising:

a silicon photocell connected as a current generator to produce a fast response output signal which is substantially linear over a wide dynamic range of intensity;

means for mounting said photocell to restrict the field of view of said photocell to a luminous region of said particular flame and the combustion chamber beyond when said flame is absent;

means for obtaining the average value of said output signal;

a comparator for comparing the fluctuation of said output signal with a fraction of said average value to produce an alternating digitized signal representing normal burner combustion; and a fail-safe circuit including a relay and circuit means responsive to said digitized signal to energize said relay only for alternating digital rates representing normal burner combustion.

11. The flame monitor according to claim 10 and including:

a second comparator for comparing said average value with a first selectable value for establishing an upper limit signal for said average value;

a third comparator for comparing said average value with a second selectable value for establishing a lower limit signal for said average value; and gating means operable to pass said alternating digitized signal to said fail-safe circuit only if said average value is within the range between said upper and lower signal levels.

12. The method of detecting flame condition comprising the steps of:

sensing rapid variations in flame intensity and determining the average intensity value thereof;

comparing said variations relative to said average intensity to indicate normal flame presence if instantaneous excursions relative to average regularly exceed a predetermined threshold; and sensing when said average intensity increases in combination with smaller excursions of said variations to indicate flame-out condition.

* * * * *